US010931047B2

(12) United States Patent
Lee et al.

(10) Patent No.: US 10,931,047 B2
(45) Date of Patent: Feb. 23, 2021

(54) CONNECTOR AND DISPLAY DEVICE HAVING THE SAME

(71) Applicant: SAMSUNG DISPLAY CO., LTD, Yongin-si (KR)

(72) Inventors: Sang Yoon Lee, Yongin-si (KR); Dong Sub Kim, Yongin-si (KR); Jin Young You, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/527,708

(22) Filed: Jul. 31, 2019

(65) Prior Publication Data

US 2020/0044375 A1 Feb. 6, 2020

(30) Foreign Application Priority Data

Jul. 31, 2018 (KR) ..... 10-2018-0089501

(51) Int. Cl.

| | |
|---|---|
| ***H01R 12/77*** | (2011.01) |
| ***H01R 13/10*** | (2006.01) |
| ***H01R 12/71*** | (2011.01) |
| ***H01R 12/78*** | (2011.01) |
| *H01R 107/00* | (2006.01) |

(52) U.S. Cl.

CPC ..... *H01R 12/778* (2013.01); *H01R 12/716* (2013.01); *H01R 12/78* (2013.01); *H01R 13/10* (2013.01); *H01R 2107/00* (2013.01)

(58) Field of Classification Search

CPC ..... H01R 12/778; H01R 12/716; H01R 13/10

USPC ..... 439/329

See application file for complete search history.

(56) References Cited

U.S. PATENT DOCUMENTS

| | | | | |
|---|---|---|---|---|
| 4,107,760 | A * | 8/1978 | Zimmer | H05K 1/0203 361/690 |
| 4,164,362 | A * | 8/1979 | Cobaugh | H01R 13/514 439/64 |
| 4,574,332 | A * | 3/1986 | Calabro | H05F 3/00 361/784 |
| 4,579,406 | A * | 4/1986 | Laursen | H05K 1/117 361/777 |
| 4,585,285 | A * | 4/1986 | Martens | H01R 25/142 361/775 |
| 4,846,699 | A * | 7/1989 | Glover | H01R 12/7005 439/64 |
| 4,983,126 | A * | 1/1991 | Busse | H01R 12/714 439/61 |
| 5,208,729 | A * | 5/1993 | Cipolla | H01L 23/467 165/80.3 |
| 5,541,802 | A * | 7/1996 | Bodahl-Johnsen | H02H 9/004 361/111 |
| 5,892,658 | A * | 4/1999 | Urda | H05K 7/20545 361/690 |

(Continued)

*Primary Examiner* — Alexander Gilman

(74) *Attorney, Agent, or Firm* — F. Chau & Associates, LLC

(57) ABSTRACT

A connector includes a header unit including a first header connection terminal, a base having a first width, and a first partition wall connected to a first end of the base and having a second width larger than the first width. The connector further includes a socket including a first socket connection terminal corresponding to the first header connection terminal. The socket is electrically connected to the header unit through the first socket connection terminal.

15 Claims, 7 Drawing Sheets

(56) References Cited

U.S. PATENT DOCUMENTS 6,142,831 A * 11/2000 Ashman ..... H01R 13/66 439/607.46
6,198,969 B1 * 3/2001 Kuzma ..... A61N 1/3752 607/37
6,246,016 B1 * 6/2001 Roessler ..... H01L 23/49805 174/261
6,341,988 B1 * 1/2002 Zhu ..... H01R 12/721 439/630
6,399,890 B1 * 6/2002 Poulter ..... H05K 1/117 174/201
6,424,845 B1 * 7/2002 Emmoft ..... G06Q 20/04 455/558
6,863,572 B1 * 3/2005 Yi ..... H01R 12/721 439/59
7,210,586 B2 * 5/2007 Ice ..... H05K 7/1404 211/26
7,423,885 B2 * 9/2008 Cady ..... G11C 5/04 174/254
7,534,127 B2 * 5/2009 Parker ..... A61N 1/3752 439/425
7,674,115 B2 * 3/2010 Midorikawa ..... H01R 13/20 439/74
7,690,104 B2 * 4/2010 Rosenblatt ..... H05K 1/148 174/254
8,282,402 B2 * 10/2012 Ngo ..... H01R 13/6273 439/79
8,449,330 B1 * 5/2013 Schroll ..... H01R 13/6586 439/607.06
8,692,124 B2 * 4/2014 Clayton ..... H01R 12/79 174/254
8,771,018 B2 * 7/2014 McGrath ..... H01R 12/72 439/630
8,845,339 B2 * 9/2014 Ono ..... H01R 12/7052 439/74
9,124,011 B2 * 9/2015 Miyazaki ..... H01R 12/716
9,337,597 B2 * 5/2016 Daamen ..... H01R 13/629
9,531,121 B1 * 12/2016 Senofsky ..... H01R 12/716
9,537,244 B2 * 1/2017 Miyazaki ..... H01R 12/57
9,996,124 B2 * 6/2018 Ent ..... G06F 1/186
10,165,670 B2 * 12/2018 Roan ..... H05K 1/189
10,305,264 B2 * 5/2019 Brett ..... H05K 7/1457
10,535,938 B2 * 1/2020 Sherman ..... H01R 13/6273
10,595,426 B2 * 3/2020 Ryu ..... G02F 1/13452
10,602,625 B2 * 3/2020 Kang ..... H05K 5/0008
10,651,588 B2 * 5/2020 Werner ..... H01R 12/716
2005/0009383 A1 * 1/2005 Okura ..... H01R 12/79 439/74
2005/0009385 A1 * 1/2005 Korsunsky ..... H01R 13/41 439/83
2009/0239409 A1 * 9/2009 Bishop ..... H01R 43/015 439/404
2011/0059632 A1 * 3/2011 Bishop ..... H01R 4/2433 439/78
2018/0110507 A1 * 4/2018 Tordi ..... A61B 17/82
2018/0115097 A1 * 4/2018 Downing ..... H01R 13/6215
2019/0361181 A1 * 11/2019 Law ..... G02B 6/4206
2020/0044375 A1 * 2/2020 Lee ..... H01R 12/778

* cited by examiner

CONNECTOR AND DISPLAY DEVICE HAVING THE SAME

CROSS-REFERENCE TO RELATED APPLICATION

The application claims priority under 35 U.S.C. § 119 to Korean Patent Application No. 10-2018-0089501, filed Jul. 31, 2018, the disclosure of which is incorporated by reference herein in its entirety.

TECHNICAL FIELD

Exemplary embodiments of the present invention relate to a connector and a display device having the same.

DISCUSSION OF THE RELATED ART

Presently, the display industry is working to develop a display device with increased resolution and size. Recently, display devices such as a full high definition (FHD) television and an ultra-high definition (UHD) television, which has approximately four times the number of pixels as that of the FHD TV, have been developed but are still under further development to have a reduced thickness with a larger size and higher definition.

In general, a display device may include a display panel for displaying an image, and a panel driving unit for supplying driving signals, such as a driving voltage, and a control signal for driving the display panel. In addition, a display device may include a support cover for supporting the display panel and the panel driving unit. The panel driving unit may include a control board for supplying driving signals, and a printed circuit board electrically connected to the display panel. The panel driving unit may further include a flexible cable for transmitting the driving signals from the control board to the printed circuit board.

The control board, the printed circuit board, and the flexible cable may be electrically connected to each other through connectors disposed in a pad portion of each configuration. The connector may be, for example, a zero insertion force (ZIF) connector or a board-to-board (BTB) connector, which are generally used. The ZIP connector and the BTB connector are provided with contact pins whose connection terminals protrude to the outside.

SUMMARY

According to an exemplary embodiment of the present invention, a connector includes a header unit including a first header connection terminal, a base having a first width, and a first partition wall connected to a first end of the base and having a second width larger than the first width. The connector further includes a socket including a first socket connection terminal corresponding to the first header connection terminal. The socket is electrically connected to the header unit through the first socket connection terminal.

In an exemplary embodiment of the present invention, the first header connection terminal is formed on the base, and the header unit further includes a second header connection terminal formed on a first surface of the first partition wall connected to the base.

In an exemplary embodiment of the present invention, the header unit further includes a second partition wall connected to a second end of the base and having a third width larger than the first width.

In an exemplary embodiment of the present invention, the third width is equal to or different from the second width.

In an exemplary embodiment of the present invention, the header unit further includes a third header connection terminal formed on a first surface of the second partition wall connected to the base.

In an exemplary embodiment of the present invention, the first partition wall further includes at least one protrusion formed on a second surface opposite to the first surface connected to the base and extending from the first partition wall.

In an exemplary embodiment of the present invention, at least one of the first partition wall and the second partition wall further includes at least one protrusion. When the first partition wall includes the at least one protrusion, the at least one protrusion is formed on a second surface opposite to the first surface of the first partition wall connected to the base and extends from the first partition wall, or when the second partition wall includes the at least one protrusion, the at least one protrusion is formed on a second surface opposite to the first surface of the second partition wall connected to the base and extends from the second partition wall.

In an exemplary embodiment of the present invention, the socket includes a body including a cavity having a shape corresponding to that of the header unit and into which the header unit is inserted, and the first socket connection terminal is formed on an inner surface of the cavity.

In an exemplary embodiment of the present invention, the cavity extends to a first side of the body to provide an opening at the first side of the body.

In an exemplary embodiment of the present invention, a portion of the header unit is exposed by the opening at the first side of the body.

In an exemplary embodiment of the present invention, the exposed portion of the header unit is in contact with an outer surface of the body.

In an exemplary embodiment of the present invention, the header unit further includes a second header connection terminal formed on a surface of the header unit. The surface of the header unit is in contact with the outer surface of the body.

In an exemplary embodiment of the present invention, the socket further includes a second socket connection terminal formed on the outer surface of the body. The outer surface of the body is in contact with the exposed portion of the header unit.

In an exemplary embodiment of the present invention, the first header connection terminal is electrically connected to wires in a cable, and the first socket connection terminal is electrically connected to wirings in a printed circuit board.

According to an exemplary embodiment of the present invention, a display device includes a display panel, a cable electrically connected to the display panel, a printed circuit board electrically connected to the cable, and a plurality of connectors electrically connecting the display panel and the cable, and the cable and the printed circuit board. At least one of the plurality of connectors includes a header unit including a first header connection terminal, a base having a first width, and a first partition wall connected to a first end of the base and having a second width larger than the first width. At least one of the plurality of connectors further includes a socket including a first socket connection terminal corresponding to the first header connection terminal. The socket is electrically connected to the header unit through the first socket connection terminal.

In an exemplary embodiment of the present invention, the first header connection terminal is formed on the base, and the header unit further includes a second header connection terminal formed on a first surface of the first partition wall connected to the base.

In an exemplary embodiment of the present invention, the header unit further includes a second partition wall connected to a second end of the base and having a third width larger than the first width.

In an exemplary embodiment of the present invention, the header unit further includes a third header connection terminal formed on a first surface of the second partition wall connected to the base.

In an exemplary embodiment of the present invention, at least one of the first partition wall and the second partition wall further includes at least one protrusion. When the first partition wall includes the at least one protrusion, the at least one protrusion is formed on a surface opposite to the surface of the first partition wall connected to the base and extends from the first partition wall, or when the second partition wall includes the at least one protrusion, the at least one protrusion is formed on a surface opposite to the surface of the second partition wall connected to the base and extends from the second partition wall.

In an exemplary embodiment of the present invention, the socket includes a body including a cavity having a shape corresponding to that of the header unit and into which the header unit is inserted, and the first socket connection terminal is formed on an inner surface of the cavity.

According to an exemplary embodiment of the present invention, a connector includes a header unit including a base extending in a first direction, a first partition wall connected to an end of the base and extending in a second direction crossing the first direction. A plurality of protrusions extend from the first partition wall in the first direction. The header unit further includes a plurality of first connection terminals disposed in the base and the first partition wall. The connector further includes a socket including a cavity configured to receive the header unit, and a plurality of second connection terminals disposed on an inner surface of the cavity. The plurality of first connection terminals are electrically connected to the plurality of second connection terminals when the header unit is disposed in the cavity of the socket.

In an exemplary embodiment of the present invention, the cavity includes a first region extending in the first direction, and a second region connected to the first region and extending in the second direction.

BRIEF DESCRIPTION OF THE DRAWINGS

The above and other features of the present invention will become more apparent by describing in detail exemplary embodiments thereof, with reference to the accompanying drawings, in which.

DETAILED DESCRIPTION OF THE EMBODIMENTS

Figure 1:
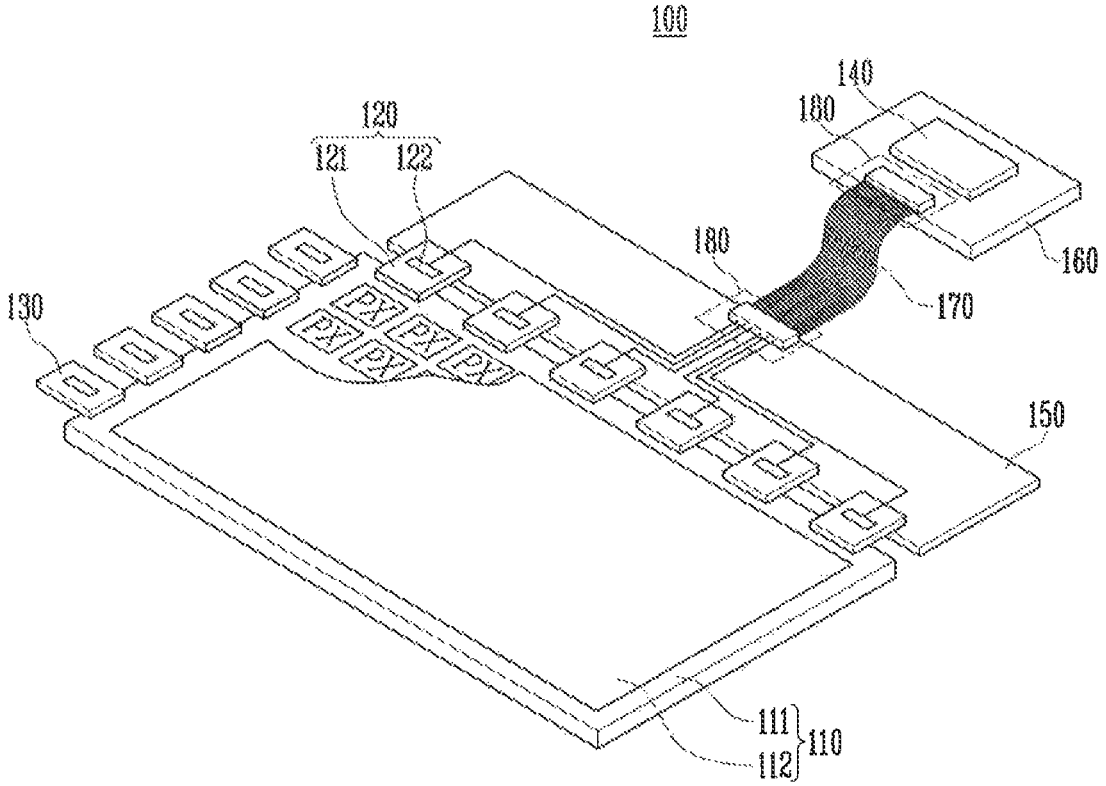
FIG. 1 is a schematic diagram of a display device according to an exemplary embodiment of the present invention.

Exemplary embodiments of the present invention will be described more fully hereinafter with reference to the accompanying drawings. It is to be understood that the present invention may, however, be embodied in different forms and thus should not be construed as being limited to the exemplary embodiments set forth herein.

In the figures, like reference numerals may refer to similar elements, and thus, repetitive descriptions may be omitted. In the drawings, the sizes and thicknesses of elements, features, layers and components in the accompanying drawings may be exaggerated for clarity of illustration.

Furthermore, when an element, layer, film, region, or plate is referred to as being "on" another element, layer, film, region or plate, the element, layer, film, region, or plate may be directly on another element, layer, film, region or plate, or intervening elements, layers, films, regions or plates may be present.

Hereinafter, a connector and a display device including the connector according to an exemplary embodiment of the present invention will be described in detail with reference to the accompanying drawings.

FIG. 1 is a schematic diagram of a display device according to an exemplary embodiment of the present invention.

Referring to FIG. 1, a display device 100, according to an exemplary embodiment of the present invention, may include a display panel 110 including a plurality of data lines and a plurality of gate lines disposed thereon. The display device 100 may further include a plurality of data drivers 120 that output data voltages to the plurality of data lines, a plurality of gate drivers 130 that output scan signals to the plurality of gate lines, and a timing controller 140 for controlling the plurality of data drivers 120 and the plurality of gate drivers 130.

The display panel 110 may include a plurality of pixels PX respectively connected to the plurality of data lines and the plurality of the gate lines. The region where each pixel PX is disposed may include a circuit element such as a transistor or the like. A data voltage may be supplied to each pixel PX through a data line, and a scan signal may be supplied thereto through a gate line. The pixel PX may be composed of various circuit elements such as one or more transistors and one or more capacitors. The number and type of circuit elements in each pixel PX may vary depending on the type of the display device 100 and a pixel design method.

The display panel 110 may include a substrate 111, and the plurality of data lines, the plurality of gate lines, and the circuit elements such as transistors included in each pixel PX are arranged on the substrate 111. In addition, other structures 112 may be disposed on the substrate 111. Here, the other structures 112 may vary depending on the type of the display device 100 (such as an organic light emitting display, a liquid crystal display, a plasma display, etc.). For example, the other structures 112 may include elements of an organic light emitting diode such as a pixel electrode, a light emitting layer and an upper electrode. For example, in a case where the display device is a liquid crystal display, the other structures 112 may include a backlight, opposing electrodes and a liquid crystal layer including liquid crystal molecules.

The plurality of data drivers 120 may drive the plurality of data lines arranged on the display panel 110. In an exemplary embodiment of the present invention, the plurality of data drivers 120 may be implemented in the form of a chip on film (COF). In other words, each of the plurality of data drivers 120 may include a film 121 and a data driver IC (D-DIC) chip 122 mounted on the film 121. Each of the plurality of data drivers 120 may be connected to the display panel 110 and a data printed circuit board (D-PCB) 150. For example, a first portion of each of the plurality of data drivers 120 may be connected to the display panel 110, and a second portion of each of the plurality of data drivers 120 may be connected to the data printed circuit board (D-PCB) 150. The data printed circuit board 150 may be referred to as a data board.

FIG. 1 illustrates the display device 100 including one data printed circuit board 150. However, the present invention is not limited thereto. For example, the display device 100 may include a plurality of data printed circuit boards 150. In other words, one side of the film 121 of each of the plurality of data drivers 120 may be connected to the display panel 110, and the other side thereof may be connected to the data printed circuit board 150.

The plurality of gate drivers 130 may drive the plurality of gate lines arranged on the display panel 110. The plurality of gate drivers 130 may be connected to one side of the display panel 110 as shown in FIG. 1 or may be connected to both sides of the display panel 110. For example, the gate driver 130 may be integrated into the display panel 110.

The timing controller 140 may be disposed on a control printed circuit board (C-PCB) 160. The control printed circuit board 160 may be referred to as a control board. The timing controller 140 may output data to the plurality of data drivers 120. In addition, the timing controller 140 may output various control signals such as a data control signal (DCS), a gate control signal (GCS), and the like to control the operation timings of the plurality of data drivers 120 and the plurality of gate drivers 130. A power management integrated circuit (PMIC) or the like may be disposed on the control printed circuit board 160.

The data printed circuit board 150 and the control printed circuit board 160 may be connected to each other through a cable 170 such as a flexible flat cable (FFC) or a flexible printed circuit board (FPCB). FIG. 1 shows a configuration in which the display device 100 includes one cable 170. However, the present invention is not limited thereto. For example, the display device 100 may include a plurality of cables 170.

The timing controller 140 and the power management integrated circuit disposed on the control printed circuit board 160 are connected to the plurality of data drivers 120, the plurality of gate drivers 130 and the display panel 110 through the cable 170 to transmit and receive signals. Here, the signals may include all electrical signals including various power sources (such as a voltage and a current), control signals, sensing signals, data signals, and the like.

The data printed circuit board 150 and the control printed circuit board 160 may be connected to the cable 170 through the connector 180 according to an exemplary embodiment of the present invention. For example, a socket 181 of the connector 180 according to an exemplary embodiment of the present invention may be provided on the data printed circuit board 150 and the control printed circuit board 160. The sockets 181 may be attached to the data printed circuit board 150 and the control printed circuit board 160 by, for example, a heat-resistant adhesive, an adhesive tape, or the like. A header unit 182 of the connector 180 according to an exemplary embodiment of the present invention may be provided at one end or both ends of the cable 170. The header unit 182 may be fastened to the socket 181 on the data printed circuit board 150 and the control printed circuit board 160.

In the above description, the connector 180 according to an exemplary embodiment of the present invention is connected to the cable 170 connecting the data printed circuit board 150 and the control printed circuit board 160, but the present invention is not limited thereto. The connector 180 according to an exemplary embodiment of the present invention may connect the display panel 110 and the plurality of data drivers 120, may connect the plurality of data drivers 120 and the data printed circuit board 150, may connect the data printed circuit board 150 and the cable 170, or may connect the cable 170 and the control printed circuit board 160.

Hereinafter, the connector 180 according to an exemplary embodiment of the present invention will be described in more detail with reference to the drawings.

Figure 2A:
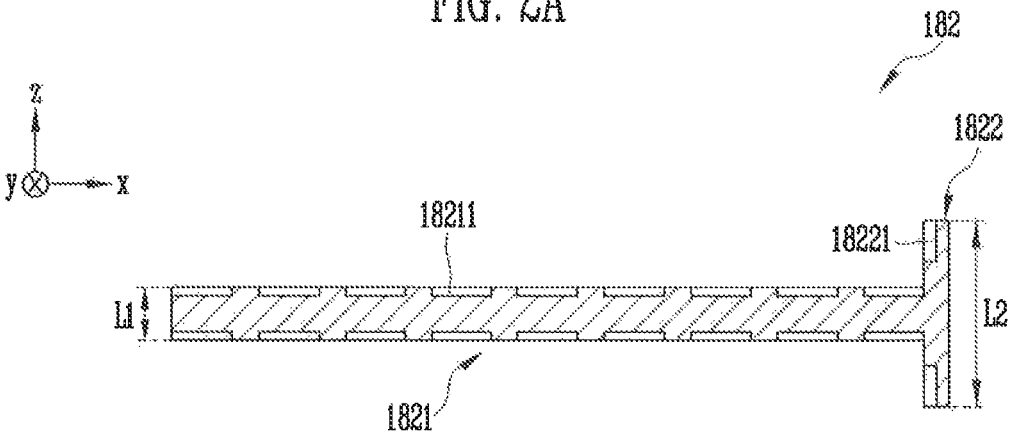
FIGS. 2A, 2B and 2C are cross-sectional views of a header unit and a socket of a connector according to an exemplary embodiment of the present invention.
Figure 2B:
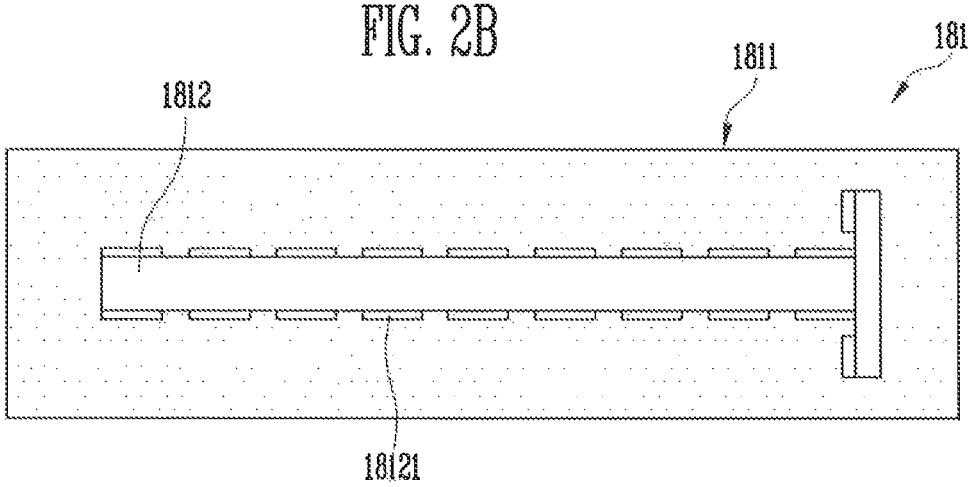
Figure 2C:
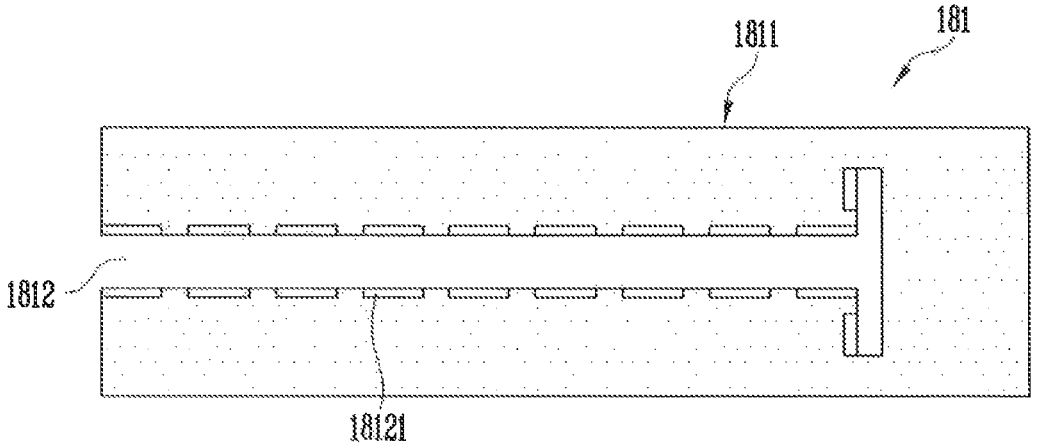

FIGS. 2A, 2B and 2C are cross-sectional views of the header unit and the socket of the connector according to an exemplary embodiment of the present invention. FIGS. 2A, 2B and 2C show cross sections of the connector 180 in a direction perpendicular to a fastening direction (e.g., a y-axis direction) of the header unit 182 and the socket 181.

Referring to FIGS. 2A to 2C, the connector 180 according to an exemplary embodiment of the present invention may include the header unit 182 shown in FIG. 2A and the socket 181 shown in FIG. 2B.

The socket 181 may be disposed on a printed circuit board (e.g., the data printed circuit board 150, the control printed circuit board 160, etc.). The header unit 182 may be coupled to the cable 170 and may be connected to the socket 181.

In an exemplary embodiment of the present invention, the header unit 182 may include a base 1821 having a first width L1 and a first partition wall 1822 connected to one end of the base 1821 in a longitudinal direction and having a second width L2. In other words, the header unit 182 may be T shaped. Here, the first width L1 is narrower than the second width L2. For example, the base 1821 and the first partition wall 1822 may be integrally formed.

At least one connection terminal 18211 is provided in the base 1821. FIGS. 2A to 2C shows an example in which at least one connection terminal 18211 is provided on at least one of the upper end surface and the lower end surface with respect to the longitudinal direction of the base 1821. The first partition wall 1822 may have at least one connection terminal 18221 provided on one surface to which the base 1821 is connected. The connection terminals 18211 and 18221 of the base 1821 and the first partition wall 1822 may be electrically connected to wires in the cable 170 coupled to the header unit 182.

The socket 181 may include a body 1811 mounted on the printed circuit board (e.g., data printed circuit board 150 and the control printed circuit board 160. The body 1811 may include a cavity 1812 having a shape corresponding to the header unit 182. Connection terminals 18121 may be formed on an inner surface of the cavity 1812 at positions corresponding to the connection terminals 18211 and 18221 formed in the header unit 182. The connection terminals 18121 in the cavity 1812 may be electrically connected to the wirings of the printed circuit board on which the socket 181 is mounted.

In an exemplary embodiment of the present invention, the cavity 1812 may extend to one side of the body 1811 to provide an opening at that one side of the body 1811. For example, the opening may be at a side opposite to a portion of the cavity 1812 that corresponds to the first partition wall 1822 as shown in FIG. 2C. Therefore, one end of the base 1821 may be exposed to the outside by the opening at the side of the body 1811 in a state where the base 1821 is inserted into the cavity 1812. In an exemplary embodiment of the present invention, a portion of the base 1821 may protrude out of the socket 181.

According to an exemplary embodiment of the present invention, the connection terminals 18211 and 18221 of the header unit 182 can be protected from the outside by the first partition wall 1822 and breakage of the connection terminals 18211 and 18221 of the header unit 182 can be prevented when the header unit 182 is fastened into the socket 181. In addition, since the header unit 182 includes the T shaped structure and the cavity 1812 of the socket 181 has a corresponding shape, the header unit 182 may not be inserted into the cavity 1812 of the socket 181 such that the header unit 182 and the socket 181 may be misaligned with each other. Thus, the misalignment between the header unit 182 and the socket 181 can be prevented.

Figure 3A:
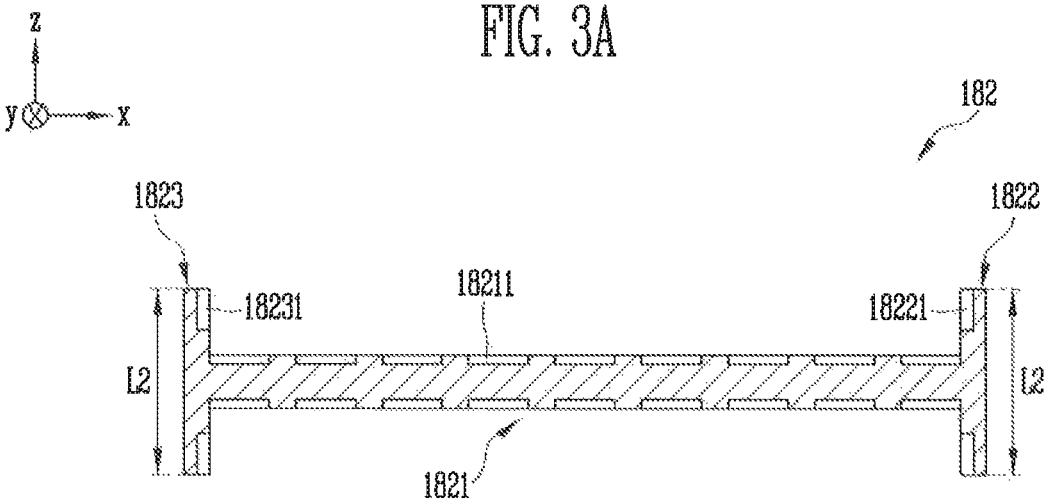
FIGS. 3A, 3B and 3C are cross-sectional views of a header unit and a socket of a connector according to an exemplary embodiment of the present invention.
Figure 3B:
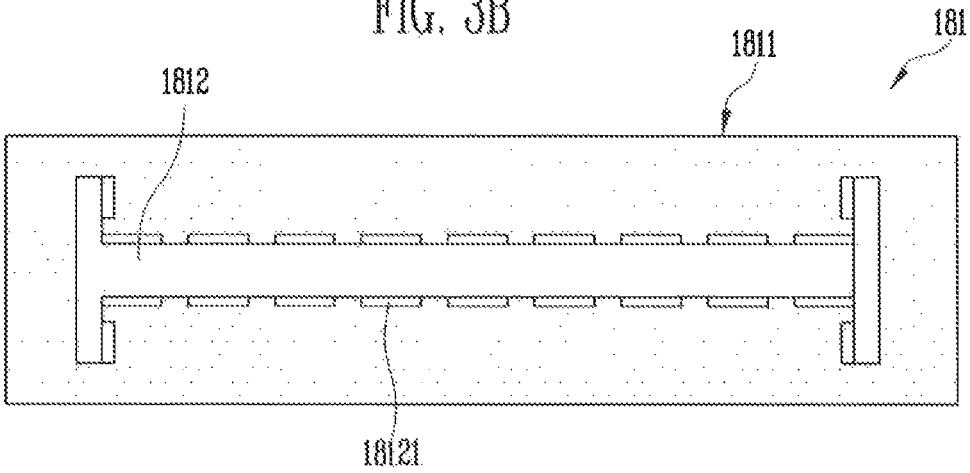
Figure 3C:
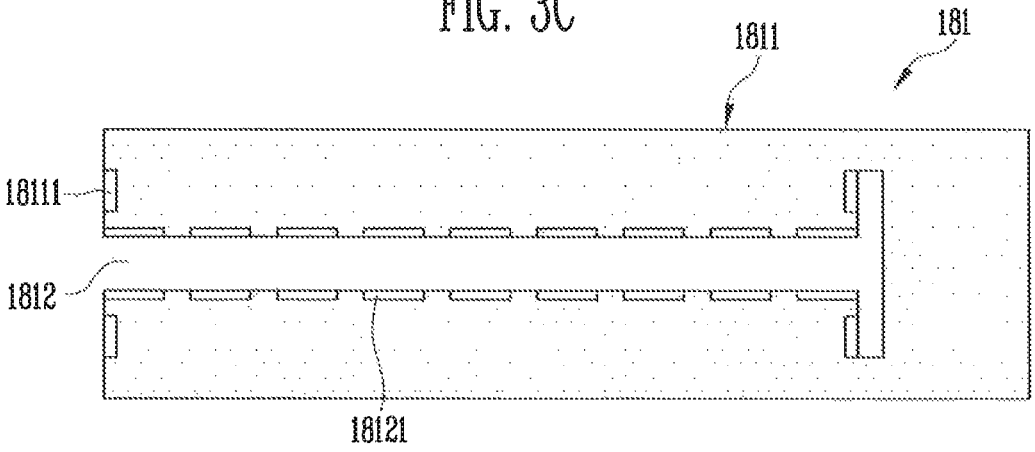

FIGS. 3A, 3B and 3C are cross-sectional views of the header unit and the socket of the connector according to an exemplary embodiment of the present invention.

The connector 180 according to an exemplary embodiment of the present invention includes the first partition wall 1822 connected to one end of the base 1821 and a second partition wall 1823 connected to the other end of the base 1821. In other words, the header unit 182 may be H shaped. FIG. 3A shows the first partition wall 1822 and the second partition wall 1823 having the same width L2. However, the present invention is not limited thereto. For example, the second partition wall 1823 may have a width different from that of the first partition wall 1822. For example, the second partition wall 1823 may have an arbitrary width greater than the base 1821.

The second partition wall 1823 may have at least one connection terminal 18231 on one surface to which the base 1821 is connected. The connection terminal 18231 of the second partition wall 1823 may be electrically connected to the wires in the cable 170 coupled to the header unit 182.

The cavity 1812 of the socket 181 may have a shape corresponding to that of the header unit 182 according to an exemplary embodiment of the present invention. Connection terminals 18121 may be formed on the inner surface of the cavity 1812 at positions corresponding to the connection terminals 18211, 18221, and 18231 formed in the header unit 182.

Figure 7:
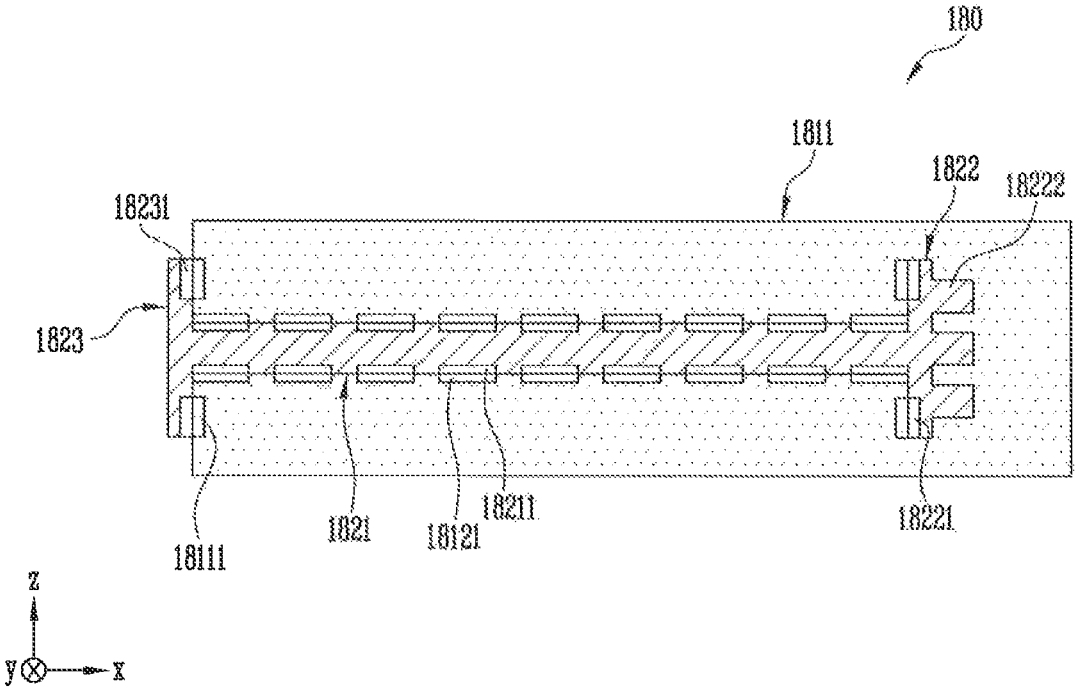
FIG. 7 is a cross-sectional view illustrating a fastened state of a connector according to an exemplary embodiment of the present invention.

In an exemplary embodiment of the present invention, the cavity 1812 may extend to one side of the body 1811 to provide an opening at that one side of the body 1811. For example, the opening may be at a side opposite to a portion of the cavity 1812 that corresponds to the first partition wall 1822 as shown in FIG. 3C. In the present embodiment, the second partition wall 1823 of the header unit 182 is not fastened in the cavity 1812 but may protrude out of the socket 181 as shown in FIG. 7. In this case, one surface of the second partition wall 1823 to which the base 1821 is connected may be in contact with the outer surface of the body 1811 of the socket 181. Here, the outer surface of the body 1811 may have a connection terminal 18111 at a position corresponding to the connection terminal 18231 of the second partition wall 1823.

In the above description, the body 1811 has an opening on the side opposite to a portion of the cavity 1812 that corresponds to the first partition wall 1822, but the present invention is not limited thereto. The body 1811 may have an opening on a side opposite to a portion of the cavity 1812 that corresponds to the second partition wall 1823, and the first partition wall 1822 may protrude outside the socket 181.

By arranging the connection terminals in the various ways as described above, a configuration of the connection between the cable 170 and the printed circuit board can be diversified. Accordingly, the connector 180 according to the present invention enables various designs of modules, circuits and other connectors of the display device 100.

In the following exemplary embodiments of the present invention, a description of substantially the same configuration and elements as that of the previously described embodiment may be omitted or simplified, and differences will be mainly described.

Figure 4A:
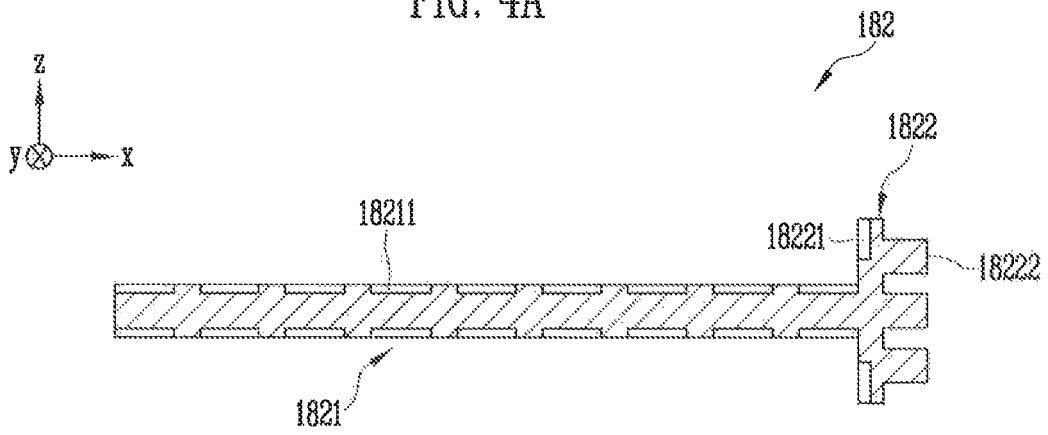
FIGS. 4A, 4B and 4C are cross-sectional views of a header unit and a socket of a connector according to an exemplary embodiment of the present invention.
Figure 4B:
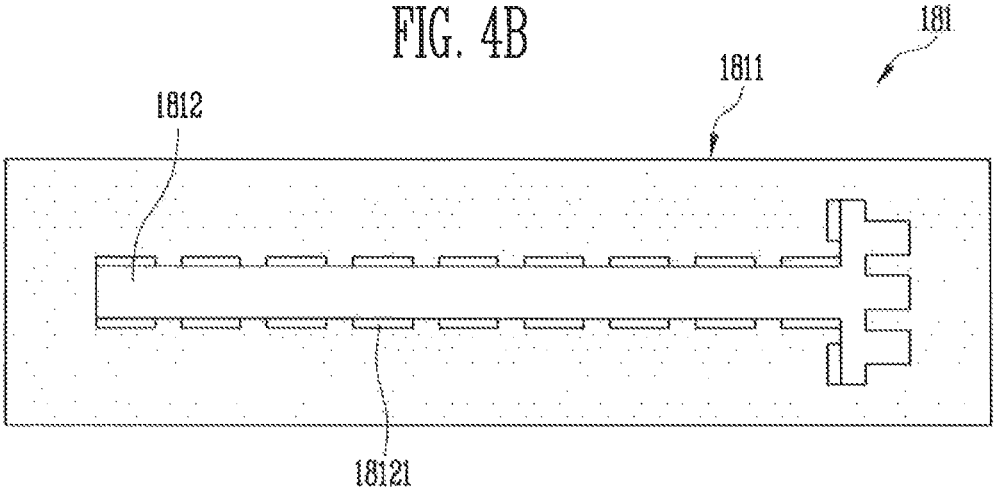
Figure 4C:
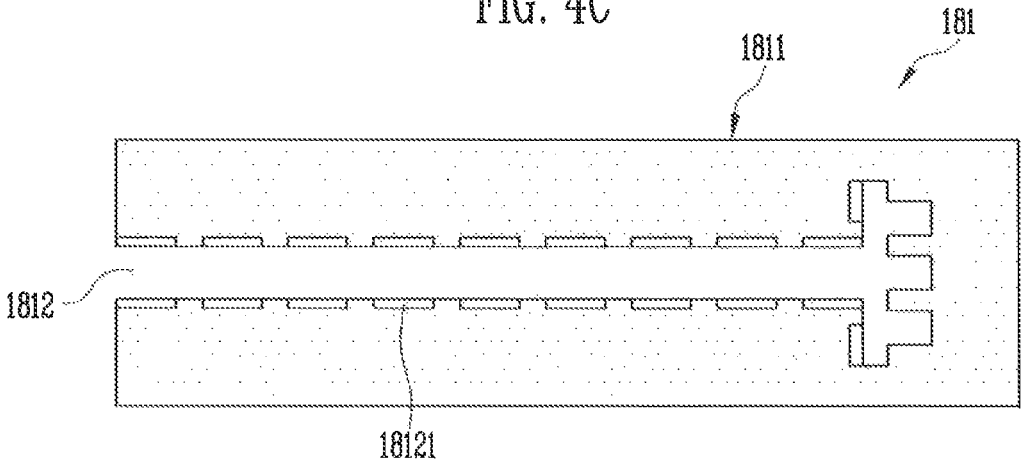

FIGS. 4A, 4B and 4C are cross-sectional views of the header unit and the socket of the connector according to an exemplary embodiment of the present invention.

The connector 180 according to an exemplary embodiment of the present invention includes at least one protrusion 18222 formed in the first partition wall 1822 as compared with the first partition wall 1822 of FIGS. 2A to 2C. The protrusion 18222 may be formed on a surface opposite to the surface connected to the base 1821 and may be extended outward (e.g., in a direction opposite to the base 1821) from the first partition wall 1822. A cross section of the protrusion 18222 may be, for example, circular, elliptical, square, rectangular, and the like, but the present invention is not limited thereto.

The cavity 1812 of the socket 181 may have a shape corresponding to that of the header unit 182 according to an exemplary embodiment of the present invention. Accordingly, the cavity 1812 can be configured to be fastened to at least one protrusion 18222 of the first partition wall 1822.

According to an exemplary embodiment of the present invention, the cavity 1812 may extend to one side of the body 1811 to provide an opening at that one side of the body 1811. For example, the opening may be at the side opposite to a portion of the cavity 1812 that corresponds to the first partition wall 1822 as shown in FIG. 4C. Accordingly, the other end of the base 1821 that corresponds to the opening is fastened in the cavity 1812 and can be exposed to the outside of the cavity 1812. In an exemplary embodiment of the present invention, a portion of the base 1821 may protrude outside the socket 181.

An engagement friction force between the header unit 182 and the socket 181 can be increased by fastening the at least one protrusion 18222 to the cavity 1812 in the above structure. This increase in frictional force may increase a fastening force between the header unit 182 and the socket 181, so that the cable 170 can be prevented from being inadvertently detached from the socket 181.

Figure 5A:
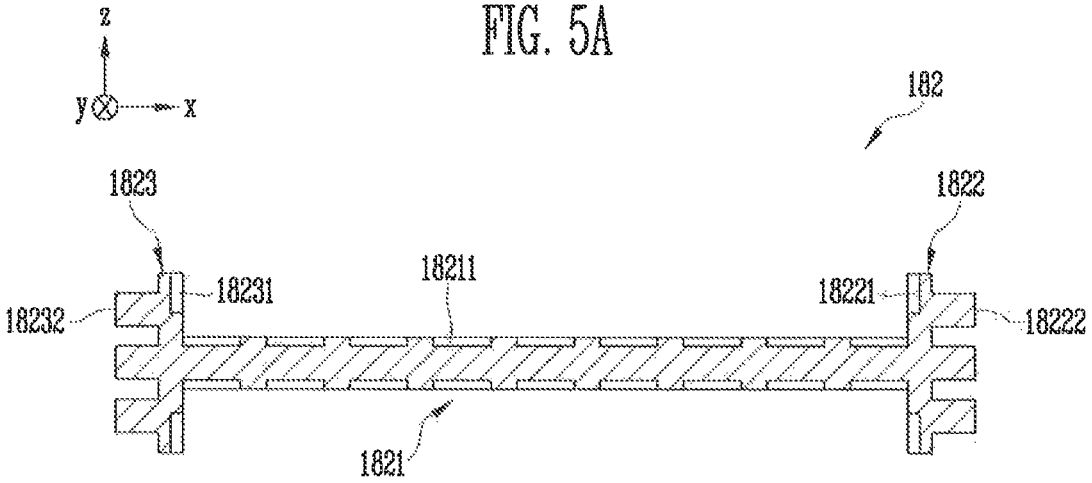
FIGS. 5A, 5B and SC are cross-sectional views of a header unit and a socket of a connector according to an exemplary embodiment of the present invention.
Figure 5B:
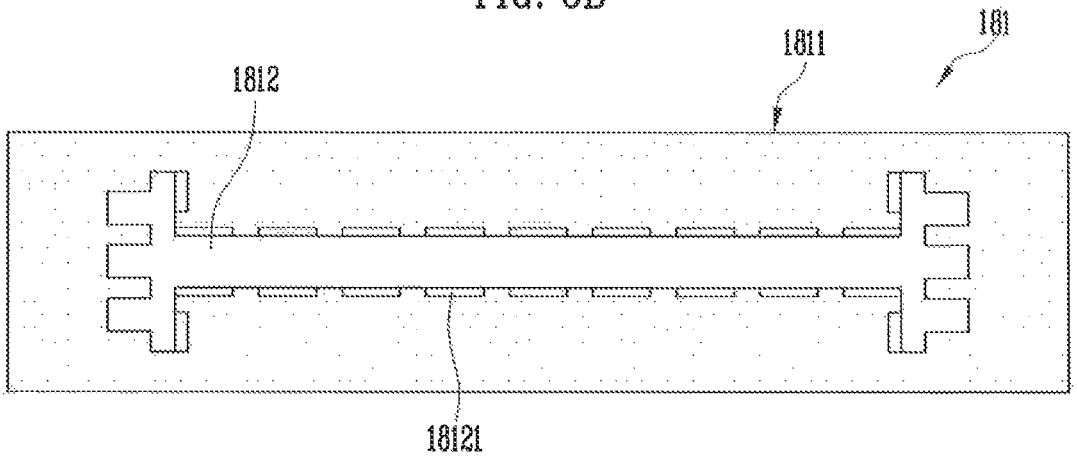
Figure 5C:
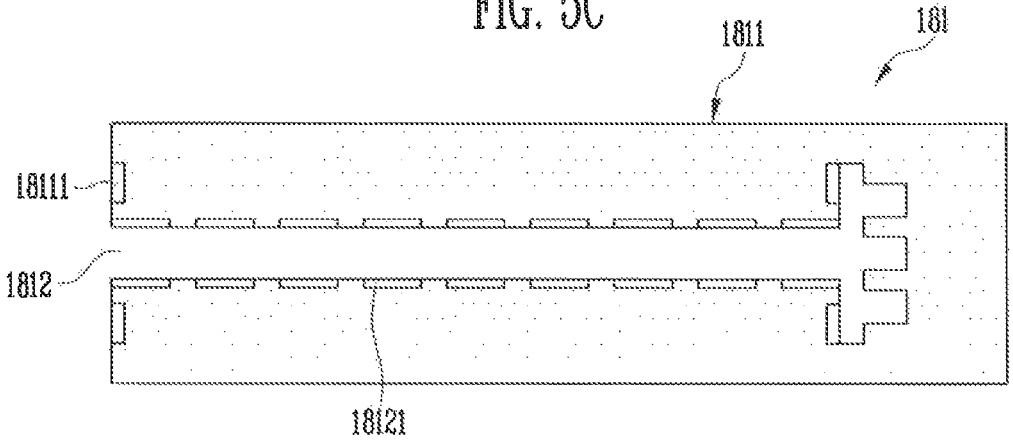

FIGS. 5A, 5B and 5C are cross-sectional views of the header unit and the socket of the connector according to an exemplary embodiment of the present invention.

The connector 180 according to an exemplary embodiment of the invention includes at least one protrusion 18232 formed in the second partition wall 1823 as compared with the header unit 182 of FIG. 4. The protrusion 18232 may be formed on a surface opposite to the surface connected to the base 1821 and may be extended outward (e.g., in the direction opposite to the base 1821) from the second partition wall 1823. A cross section of the protrusion 18232 may be, for example, circular, elliptical, square, rectangular, and the like, but the present invention is not limited thereto. According to an exemplary embodiment of the present invention, the protrusion 18232 of the second partition wall 1823 may have a symmetrical shape with respect to the protrusion 18222 of the first partition wall 1822.

The cavity 1812 of the socket 181 may have a shape corresponding to that of the header unit 182 according to an exemplary embodiment of the present invention. Accordingly, the cavity 1812 can be configured to be fastened to at least one protrusion 18232 of the second partition wall 1823.

Figure 6A:
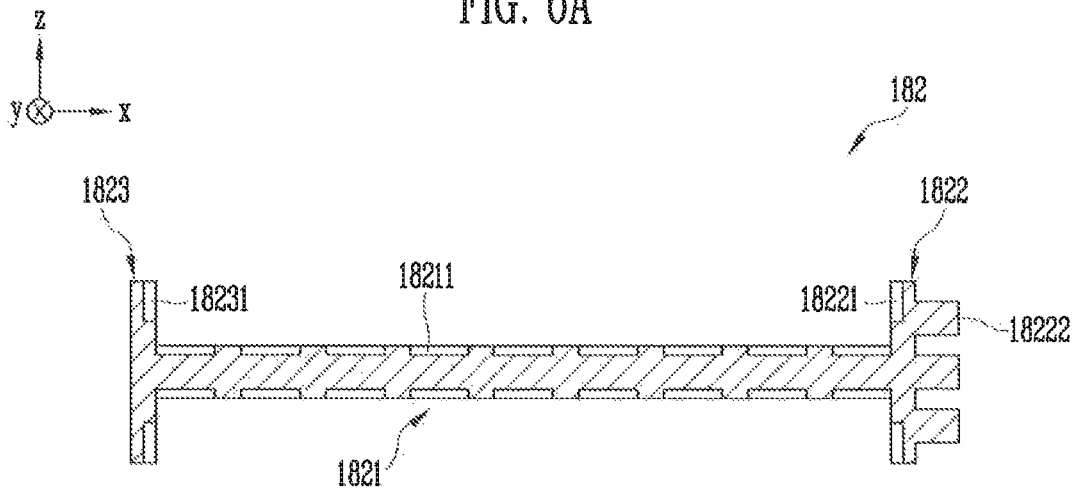
FIGS. 6A, 6B and 6C are cross-sectional views of a header unit and a socket of a connector according to an exemplary embodiment of the present invention.
Figure 6B:
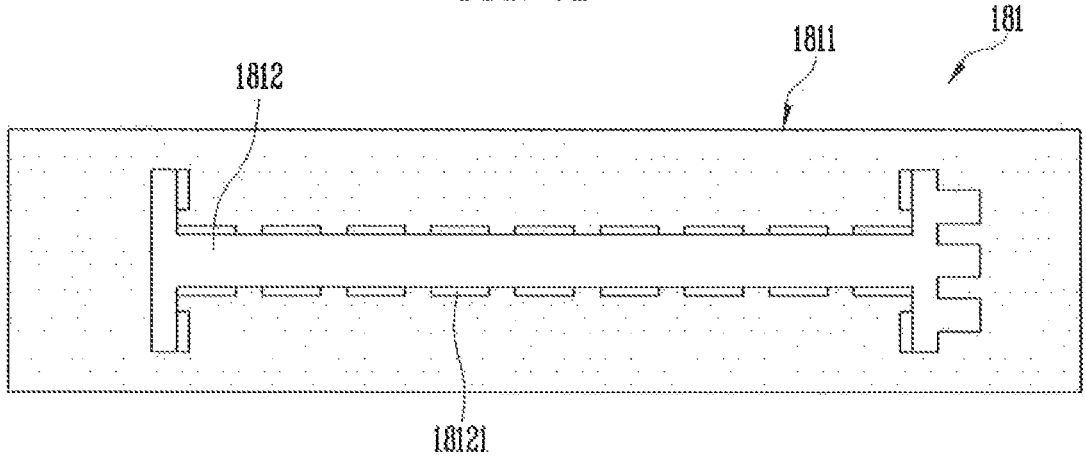
Figure 6C:
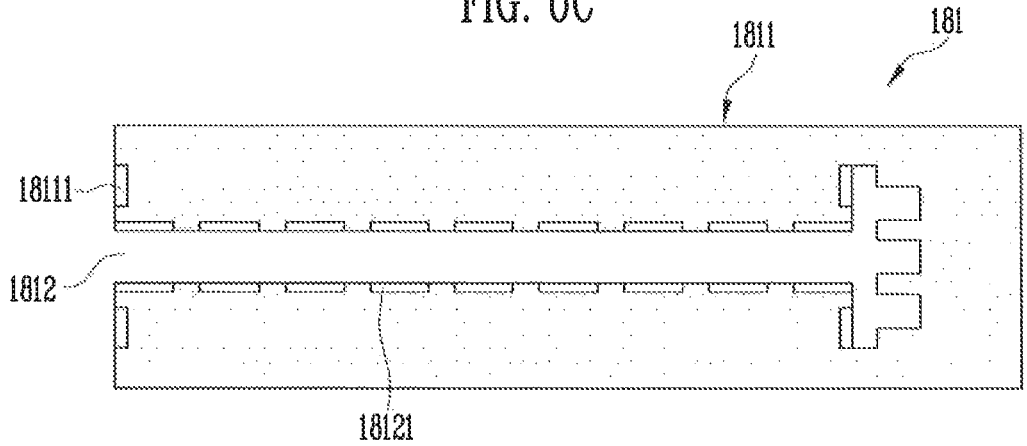

FIGS. 6A, 6B and 6C are cross-sectional views of the header unit and the socket of the connector according to an exemplary embodiment of the present invention.

As compared with the connector 180 of FIG. 5, the connector 180 according to an exemplary embodiment of the present invention may have at least one protrusion 18222 extending from the first partition wall 1822, but the second partition wall 1823 does not have any projection or protrusion extending therefrom.

FIGS. 6A, 6B, and 6C illustrate an example in which the protrusion 18222 is formed only in the first partition wall 1822, but the present invention is not limited thereto. The protrusion 18222 may not be formed in the first partition wall 1822 and the protrusion 18232 may be formed in the second partition wall 1823.

The cavity 1812 of the socket 181 may have a shape corresponding to that of the header unit 182 according to an exemplary embodiment of the present invention. Accordingly, the cavity 1812 can be configured to be fastened to the at least one protrusion 18222 of the first partition wall 1822.

In an exemplary embodiment of the present invention, the cavity 1812 may extend to one side of the body 1811 to provide an opening at that one side of the body 1811. For example, the opening may be at a side opposite to a portion of the cavity 1812 that corresponds to the first partition wall 1822 as shown in FIG. 6C. In the present embodiment, the second partition wall 1823 may not be fastened in the cavity 1812 and may protrude out of the socket 181 as shown in FIG. 7. In this case, one surface of the second partition wall 1823 to which the base 1821 is connected is in contact with the outer surface of the body 1811 of the socket 181. Here, the outer surface of the body 1811 may have a connection terminal 18111 at a position corresponding to the connection terminal 18231 of the second partition wall 1823.

FIG. 7 is a cross-sectional view illustrating a fastened state of the connector according to an exemplary embodiment of the present invention.

FIG. 7 shows the fastening state of the connector 180 according to an exemplary embodiment of the present invention. The header unit 182 is formed in an H shape including the first partition wall 1822 and the second partition wall 1823, and the protrusion 18222 is formed in the first partition wall 1822. In addition, one side of the cavity 1812 facing the second partition wall 1823 is opened as shown in FIG. 6C, and the second partition wall 1823 is abutted against the outer surface of the body 1811 without being fastened in the cavity 1812.

The connector 180 according to an exemplary embodiment of the invention can protect the connection terminals 18211, 18221, and 18231 by the partition walls 1822 and 1823. Therefore, breakage of the connection terminals 18211, 18221, and 18231 can be prevented when the header unit 182 and the socket 181 are coupled to each other. In addition, since the connector 180 according to an exemplary embodiment of the present invention is formed in a T shape or an H shape, misalignment between the header unit 182 and the socket 181 can be prevented.

The connection terminals in the connector 180 according to an exemplary embodiment of the present invention may be arranged in various ways. Therefore, the configuration of the connection between the cable 170 and the printed circuit board can be diversified, so that various modules and circuits of the display device 100 can be designed in various ways.

In addition, the connector 180 according to an exemplary embodiment of the present invention can increase the coupling force between the header unit 182 and the socket 181 by the protrusions 18222 and 18232 provided in the partition walls 1822 and 1823. Therefore, the cable 170 can be prevented from separating from the printed circuit board.

The cable and the display device including the same according to an exemplary embodiment of the present invention can increase the convenience of the operator by preventing breakage of contact pins due to misalignment between the socket 181 and the header unit 182 when the connector 180 is fastened, and can increase the work efficiency by reducing the fastening time.

The cable and the display device including the same according to an exemplary embodiment of the present invention can prevent the unintentional disconnection between the cable and the socket because a protrusion is provided at both ends of the "H" shaped header unit of a connector and the socket has a shape that corresponds to that of the header unit. For example, both ends of the "H" shaped header unit may include a plurality of protrusions with a saw tooth structure. In addition, a protrusion may be provided at one end of the "T" shaped header unit.

In addition, the cable and the display device including the same according to an exemplary embodiment of the present invention eliminates the limitation of the configuration of the connection between the cable and the substrate, thereby enabling various designs of the modules and circuits in the display device.

An exemplary embodiment of the present invention provides a connector having an H shape or a T shape to prevent breakage due to misalignment when the connector is fastened, and a display device having the same.

An exemplary embodiment of the present invention provides a connector configured to increase the fastening force between a cable and a socket by providing a protrusion of a saw tooth structure at an end of an H shaped or T shaped connector, and a display device having the same.

While the present invention has been particularly shown and described with reference to exemplary embodiments thereof, it will be apparent to those of ordinary skill in the art that various changes in form and detail may be made thereto without departing from the spirit and scope of the present invention.

What is claimed is:

1. A connector comprising:

a header unit including:

a first header connection terminal;

a base having a first width and extending in a first direction;

a first partition wall connected to a first end of the base and having a second width larger than the first width; and a second header connection terminal formed on a first surface of the first partition wall, wherein the first surface of the first partition wall faces the first direction; and a socket including a first socket connection terminal corresponding to the first header connection terminal, wherein the socket is electrically connected to the header unit through the first socket connection terminal.

2. The connector of claim 1, wherein the first header connection terminal is formed on the base.

3. The connector of claim 2, wherein the first partition wall further includes at least one protrusion formed on a second surface opposite to the first surface connected to the base and extending from the first partition wall.

4. The connector of claim 2, wherein the header unit further includes a second partition wall connected to a second end of the base and having a third width larger than the first width.

5. The connector of claim 4, wherein the third width is equal to or different from the second width.

6. The connector of claim 4, wherein the header unit further includes a third header connection terminal formed on a first surface of the second partition wall connected to the base.

7. The connector of claim 6, wherein at least one of the first partition wall and the second partition wall further includes at least one protrusion, wherein when the first partition wall includes the at least one protrusion, the at least one protrusion is formed on a second surface opposite to the first surface of the first partition wall connected to the base and extends from the first partition wall, or when the second partition wall includes the at least one protrusion, the at least one protrusion is formed on a second surface opposite to the first surface of the second partition wall connected to the base and extends from the second partition wall.

8. The connector of claim 1, wherein the socket includes a body including a cavity having a shape corresponding to that of the header unit and into which the header unit is inserted, and the first socket connection terminal is formed on an inner surface of the cavity.

9. The connector of claim 8, wherein the cavity extends to a first side of the body to provide an opening at the first side of the body.

10. The connector of claim 9, wherein a portion of the header unit is exposed by the opening at the first side of the body.

11. The connector of claim 10, wherein the exposed portion of the header unit is in contact with an outer surface of the body.

12. The connector of claim 11, wherein the header unit further comprises a third header connection terminal formed on a surface of the header unit, wherein the surface of the header unit is in contact with the outer surface of the body.

13. The connector of claim 12, wherein the socket further, includes a second socket connection terminal formed on the outer surface of the body, wherein the outer surface of the body is in contact with the exposed portion of the header unit.

14. The connector of claim 1, wherein the first header connection terminal is electrically connected to wires in a cable, and the first socket connection terminal is electrically connected to wirings in a printed circuit board.

15. The display device of claim 1, wherein the second header connection terminal and the first surface of the first partition wall are coplanar.

* * * * *